US005888686A

United States Patent [19]

Hirose et al.

[11] Patent Number: 5,888,686

[45] Date of Patent: Mar. 30, 1999

[54] TONER, DEVELOPER AND IMAGE FORMING METHOD EMPLOYING THE TONER

[75] Inventors: Naohiro Hirose; Tomoe Kikuchi; Kenji Hayashi; Yoshiki Nishimori; Mikio Kohyama, all of Hino, Japan

[73] Assignee: Konica Corporation, Japan

[21] Appl. No.: 948,169

[22] Filed: Oct. 9, 1997

[30] Foreign Application Priority Data

Oct. 14, 1996 [JP] Japan ..... 8-270545

[51] Int. Cl.[6] ..... G03G 9/087

[52] U.S. Cl. ..... 430/106; 430/111

[58] Field of Search ..... 430/109, 108, 430/106, 111

[56] References Cited

U.S. PATENT DOCUMENTS

| | | | |
|---|---|---|---|
| 4,931,375 | 6/1990 | Akimoto et al. | 430/109 |
| 5,338,638 | 8/1994 | Tsuchiya et al. | 430/109 |

*Primary Examiner*—John Goodrow

*Attorney, Agent, or Firm*—Jordan B. Bierman; Bierman, Muserlian and Lucas

[57] ABSTRACT

Disclosed is a toner for developing an electrostatic latent image, the toner containing polymer particles having a carboxyl group on the surface thereof in the range of $$5\times10^{-11}\ \text{mol/cm}^2 \leqq A \leqq 3\times10^{-9}\ \text{mol/cm}^2$$

wherein A represents an amount of the carboxyl group obtained using a conductometric titration method.

8 Claims, 3 Drawing Sheets

TONER, DEVELOPER AND IMAGE FORMING METHOD EMPLOYING THE TONER

FIELD OF THE INVENTION

The present invention relates to copiers, printers and the like, and more specifically to a toner for developing an electrostatic latent image, a developer and an image forming method employing the toner, which are used in color copiers, color printers and the like.

BACKGROUND OF THE INVENTION

Conventionally, a toner employed for the development in electrophotograpy has been prepared generally by a method in which a colorant (carbon black, magnetic powder, pigment, etc.), a charge control agent and other additives are melt kneaded in a thermoplastic resin, pulverized and classified.

In order to overcome various disadvantages of the toner prepared by the pulverization method, preparation methods such as an emulsion polymerization method, a suspension polymerization method, etc. have been developed. (Japanese Patent Publication Nos. 36-10231, 47-518305, 51-14895, etc.)

However, these conventional toners have various disadvantages. There have been problems specially on the stability of charge amount and charge rising at the repeated use.

SUMMARY OF THE INVENTION

An object of the present invention is to provide a toner for developing an electrostatic latent image, a developer and an image forming method employing the toner, which have excellent charging properties, and of which characteristics are not varied at the repeated use under environments of low temperature and low humidity, or high temperature and high humidity.

DETAILED DESCRIPTION OF THE INVENTION

Figure 1:
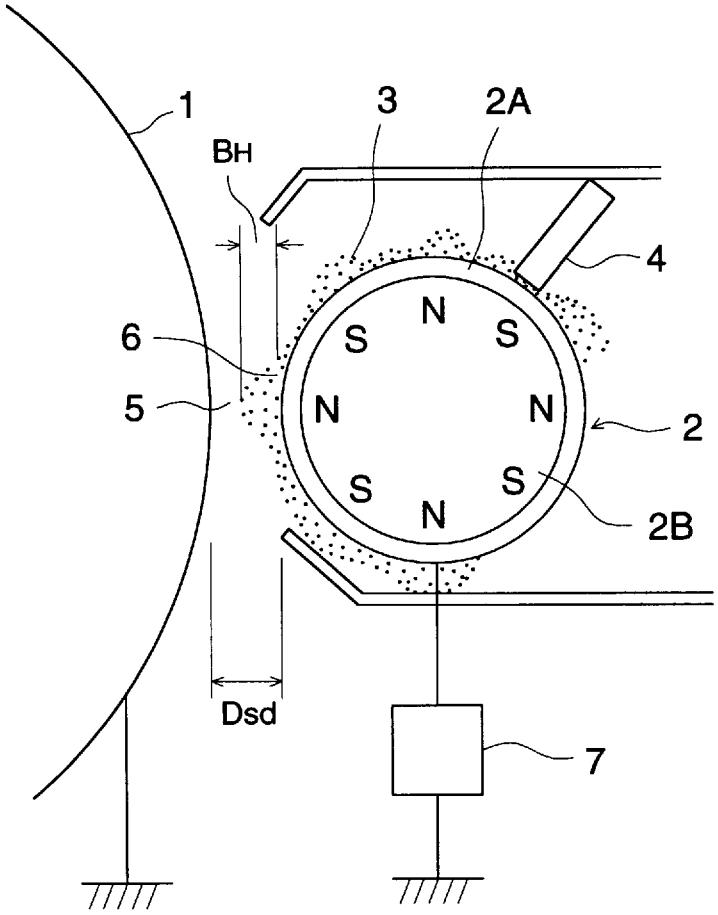
FIG. 1 is a schematic diagram illustrating one example of non-contact developing system.

The above object of the present invention has been attained by the followings:

(1) A toner for developing an electrostatic latent image, which is characterized in that the toner is prepared by polymer particles having a carboxyl group (hereinafter referred to also as a surface carboxyl group) on the surface in the range of $5\times10^{-11}$ mol/cm$^2 \leqq A \leqq 3\times10^{9}$ mol/cm$^2$ wherein A represents the carboxyl group amount obtained using a conductometric titration method.

(2) The toner for developing an electrostatic latent image of the item (1), which is characterized by having a BET specific surface area of 5 to 100 m$^2$/g.

(3) A developer which is characterized by comprising a toner for developing an electrostatic latent image, which is prepared by polymer particles having a carboxyl group on the surface in the range of $5\times10^{-11}$ mol/cm$^2 \leqq A \leqq 3\times10^{9}$ mol/cm$^2$ wherein A represents the carboxyl group amount obtained using a conductometric titration method, and a carrier.

(4) In an image forming method in which an electrostatic latent image formed on a photoreceptor is actualized as a toner image, the image forming method which is characterized in that an employed toner for developing an electrostatic latent image is prepared by polymer particles having a carboxyl group on the surface in the range of $5\times10^{-11}$ mol/cm$^2 \leqq A \leqq 3\times10^{9}$ mol/cm$^2$ wherein A represents the carboxyl group amount obtained using a conductometric titration method and has a BET specific surface area of 5 to 100 m$^2$/g.

(5) In an image forming method in which superimposed images formed on a photoreceptor are simultaneously transferred to an image receiving material, the image forming method which is characterized in that an employed toner for developing an electrostatic latent image is prepared by polymer particles having a carboxyl group on the surface in the range of $5\times10^{-11}$ mol/cm$^2 \leqq A \leqq 3\times10^{9}$ mol/cm$^2$ wherein A represents the carboxyl group amount obtained using a conductometric titration method, and has a BET specific surface area of 5 to 100 m$^2$/g.

(6) In an image forming method in which a toner image formed on a photoreceptor is transferred to an image receiving material and the toner remaining on the photoreceptor is then removed with cleaning, the image forming method which is characterized in that an employed toner for developing an electrostatic latent image is prepared by polymer particles having a carboxyl group on the surface in the range of $5\times10^{-11}$ mol/cm$^2 \leqq A \leqq 3\times10^{9}$ mol/cm$^2$ wherein A represents the carboxyl group amount obtained using a conductometric titration method, and has a BET specific surface area of 5 to 100 m$^2$/g.

In the present invention, the amount A of the carboxyl group on the surface of polymer particles (latex) which are precursors for preparing the toner (hereinafter referred to also as the toner of the present invention) for developing an electrostatic latent image is required to be in the range of $5\times10^{-11}$ mol/cm$^2 \leqq A \leqq 3\times10^{-9}$ mol/cm$^2$ and is preferably in the range of $8\times10^{-11}$ mol/cm$^2 \leqq A \leqq 1.5\times10^{-9}$ mol/cm$^2$. In this range, it is possible to obtain the toner in which stability of the charge amount is excellent for a long period of time and to obtain images which causes no fog formation and no decrease in density at the beginning and after the repeated production of copies.

On the other hand, when the amount of the carboxyl group on the surface of the polymer particles employed for the toner production is less than $5\times10^{-11}$ mol/cm$^2$, under the condition of low temperature and low humidity, the charge amount rises after the repeated copying and the decrease in density is caused. Furthermore, when the amount of the carboxyl group on the surface of the polymer particles is larger than $3\times10^{-9}$ mol/cm$^2$, under the condition of high temperature and high humidity, the charge amount falls down after the repeated copying and fog is formed.

Any of known methods may be employed for the quantitative analysis of the amount of the surface carboxyl group. However, the amount of carboxyl group is preferably measured by conductometric titration, potentiometric titration, electrophoresis or medium pressure chromatography as seen in the references such as Poehlen G. W., Ottewill R. H., Goodwin J. W.; Science and Technology of Polymer Colloids, Volume II, p 449, etc.

In order to compare to the other particle, a value per unit surface area was employed which was derived by dividing the value by the surface area of the particle.

The particle size which is utilized for the calculation of the surface area of the particle may be measured using any of particle size measurement apparatuses which can measure a particle size of 0.09 μm or more. In the present invention, an electrophoresis particle size measurement apparatus was employed.

As the amount of the surface carboxyl group, the surface area of the particles was employed which was obtained by the calculation in terms of perfect sphere according to the average particle size (D50) obtained by measurement.

There is no limitation on the production method for the toner of the present invention as described later, when the toner is compatible with the above-mentioned conditions. However, the BET specific area is preferably in the range of 5 to 100 $m^2/g$ and the toner having much larger specific surface area is preferably employed.

The BET specific surface area was measured using a Flowsorp II 2300 manufactured by Shimadzu Corporation employing a one point method under $N_2$ gas flow.

(Toner for Developing Electrostatic Latent Image)

The toner for developing an electrostatic latent image of the present invention may be prepared by a pulverization method or by a polymerization method to yield so-called a polymer toner.

When the toner is prepared by the pulverization method, known methods may be employed which have been well practiced. Namely, polymer particles prepared by emulsion polymerization, granulation polymerization, etc. are once dried to form a block-like resin to which additives such as a colorant, etc. are added to result in the required functions as the toner and are subjected to kneading upon heating, pulverization and classification to obtain the toner having a predetermined particle size.

However, as a method for obtaining the toner of the present invention, as described in the following, the toner is preferably prepared using the so-called polymerization method in which latex-like particles are prepared using granulation polymerization, suspension polymerization, etc., and with employing the latex-like particles, toner particles are directly prepared without performing the pulverization process, etc.

In the toner prepared by the polymerization method preferably employed in the present invention, suspension polymerization, emulsion polymerization or the like is performed under the presence of additives such as a colorant, a releasing agent, etc., required for the toner for developing an electrostatic latent image. Thus, polymer particles comprising these colorant and releasing agent are prepared. Preferably is a method which makes it possible to control readily the size distribution and its shape of the toner obtained in which particularly preferably, polymer particles are synthesized employing the emulsion polymerization in an aqueous dispersion medium and a plurality of resulting particles are associated so that polymer particles having a desired particle size as the toner are obtained.

The detailed preparation method is as follows. Firstly, a polymerization process is described. A colorant which has been treated with a surface improving agent if desired is dispersed in an aqueous solution in which the dispersion concentration of a surface active agent is the same as the CMC (critical micelle concentration) or higher; the resulting dispersion is then diluted so that the concentration of the surface active agents is the same as the CMC or lower; a water-soluble radical polymerization initiator is dissolved in the resulting dispersion; further, monomers are added followed by an aqueous deposition polymerization, and polymer fine particles comprising the above-mentioned colorant are obtained. Next, an association process is explained in which an organic solvent is added which is infinitely soluble to a coagulating agent having a concentration of critical coagulation concentration of the polymer fine particle dispersion or more and water, and does not dissolve the above-mentioned polymer fine particles, and a plurality of the above-mentioned polymer fine particles are associated to form associated colored particles. The volume average particle size of the colored particles is preferably 0.05 to 0.25 μm, and more preferably 0.05 to 0.15 μm.

Organic solvents, which are infinitely soluble in water and do not dissolve the polymer fine particles, include specifically alcohol series solvents such as methanol, ethanol, isopropanol, butanol, allylalcohol, ethylene chlorohydrin, ethylene glycol and glycerin. Especially, isopropanol is preferred.

The process in which the organic solvent is added is preferably performed at room temperature, that is, from about 0° to about 40° C. after the formation of the polymer fine particles. Furthermore, a ratio of the organic solvent to water in a mixed solvent is in the range of 1:1 to 1:1,000 and preferably in the range of 1:4 to 1:100.

Furthermore, it is possible to prepare a toner having the BET specific surface area of the present invention by performing the fusion upon heating to a temperature of a glass transition point of the formed polymer itself or higher.

In the following, production apparatuses and raw materials employed for the production are explained with reference to specific representative examples.

(Production Apparatuses)

(1) Stirring Vessel

There is no particular limitation on the shape of a reaction vessel for conducting the association. However, an ordinary cylindrical or spherical reaction vessel is preferred.

(2) Stirrer Fan

The shape of the stirrer fan for the association is not particularly limited. Examples include an anchor blade, a turbine blade, Foudler blade, Maxblend blade. paddle fan, helical ribbon blade, bull margin blade, etc.

(Monomers)

As polymerizable monomers, a hydrophobic monomer is preferably employed, and a hydrophilic monomer or a cross-linkable monomer are optionally employed.

(1) Hydrophobic Monomers

The hydrophobic monomer is not specially limited and conventionally known monomers may be employed. Furthermore, combination of one kind or more may be employed in order to meet required characteristics.

Specifically, are employed vinyl aromatic series monomers, α-methylene aliphatic carboxylic acid ester series monomers such as an acrylic acid ester series monomer, a methacrylic acid ester series monomer, etc., vinyl ester series monomers, vinyl ether series monomers, mono-olefin series monomers, di-olefin series monomer, halogenated olefin series monomers, etc.

The vinyl aromatic series monomers include, for example, styrene series monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, etc. and their derivatives.

The α-methylene aliphatic carboxylic acid ester series monomers include methyl acrylate, ethyl acrylate, butyl acrylate, 2-ethylhexyl acrylate, cyclohexyl acrylate, phenyl acrylilate, metyl methacrylate, butyl methaacrylate, hexyl methacrylate, 2-ethylhexyl methacrylate, ethyl β-hydroxyacrylate, propyl γ-aminoacrylate, stearyl methacrylate, dimethylaminoethyl methacrylate, diethylaminoethyl methacrylate, etc.

The vinylester series monomers include vinyl acetate, vinyl propionate, vinyl benzoate, etc.

The vinyl ether series monomers include vinyl methyl ether, vinyl ethyl ether, vinyl isobutyl ether, vinyl phenyl ether, etc.

The mono-olefin series monomers include ethylene, propylene, isobutylene, 1-butene, 1-pentene, 4-methyl-1-pentene, etc.

Diolefin series monomers include butadiene, isoprene, chloroprene, etc.

(2) Hydrophilic Monomers

Hydrophilic monomers are not specially limited and conventionally known monomers may be employed. Furthermore, the combination of one kind or more may be employed so as to meet required characteristics.

For example, may be employed carboxyl group containing monomers, sulfonic acid containing monomers, amine series compounds such as primary amine, secondary amine, tertiary amine, quaternary ammonium salts, etc.

The carboxylic acid containing monomers include acrylic acid, methacrylic acid, phmalic acid, maleic acid, itaconic acid, cinnamic acid, maleic acid monobutyl ester, maleic acid monoctyl ester, etc.

The sulfonic acid containing monomers include styrenesulfonate, allylsulfosuccinate, allylsulfocinnamic acid octyl, etc.

Amine series compounds include dimethylaminoetyl acrylate, dimethylaminoethyl methacrylate, diethylaminoethyl acrylate, diethylaminoethyl methacrylate, 3-dimethlaminophenyl acrylate, 2-hydroxy-3-methacryloxypropyltrimethyl ammonium salt, etc.

(3) Cross-linkable Monomers

In order to improve the characteristics of the polymer particles, a cross-linkable monomer may be added. The cross-linkable monomers include compounds having at least two unsaturated bonds such as divinylbenzene, divinylnaphthalene, divinylether, diethyleneglycol dimethacrylate, diallylphthalate, etc.

As the monomers related to the present invention are preferably employed a hydrophobic monomer of 85 to 99.9 weight percent and a hydrophilic monomer of 0.1 to 15 weight percent.

(Chain Transfer Agents)

Aiming at the adjustment of molecular weight, generally used chain transfer agents may be employed.

The chain transfer agents are not specially limited. Examples include mercapatans such as octylmercaptan, dodecylmercaptan, tert-dodecylmercapatan, etc.

(Polymerization Initiators)

Water-soluble radical polymerization initiators may be optionally employed in the present invention. For example, are listed persulfate salts (potassium persulfate, ammonium persulfate, etc.), azo series compounds (4,4'-azobis-4-cyano valeic acid and its salt, 2,2'-azobis(2-amodinopropane) salt, etc. peroxide compounds.

Furthermore, the above-mentioned radical polymerization initiator may be employed in combination with a reducing agent if desired, and may be employed as a redox system initiator. The use of the redox system initiator enables the increase in polymerization activity and the decrease in polymerization temperature. As a result, the decrease in polymerization time may be expected.

The polymerization temperature is not limited if the temperature is higher than the lowest temperature at which the polymerization initiator induces the formation of a radical. The temperature range of 50° to 80° C. is employed. However, the use of the polymerization initiator such as, for example, a combination of hydrogen peroxide-reducing agent (ascorbic acid, etc.) which enables initiation at room temperature makes it possible to conduct the polymerization at room temperature or lower.

(Surface Active Agents)

Surface active agents include sulfonic acid salts (sodium dodecybenzenesulfonate, sodium arylalkylpolyethersulfonate, sodium 3,3-disulfondiphenylurea4,4-diazo-bis-amino-8-naphthol-6-sulfonate, ortho-carboxybenzene-azo-dimethylaniline, sodium 2,2,5,5-tetramethyl-triphenylmethane-4,4-diazo-bis-β-naphthol-6-sulfonate, etc.), sulfonic ester salts (sodium tetradecylsulfate, sodium pentadecylsulfate, sodium octylsulfate, etc.), fatty acid salts (sodium oleate, sodium laurate, sodium caprate, sodium caprylate, sodium caproate, potassium stearate, calcium oleate, etc.)

(Colorants)

Colorants include inorganic pigments and organic pigments.

(1) Inorganic Pigments

Conventionally known inorganic pigments may be employed. Though any of pigments may be employed, in the following, specific inorganic pigments are shown.

Black pigments include, for example, carbon blacks such as firness black, channel black, acetylene black, thermal black, lamp black, etc., and in addition, magnetic powders such as magnetite, ferrite, etc.

These inorganic pigments may be employed individually or in combination in accordance with requirements. Furthermore, the addition amount of the pigment is generally in the range of 2 to 20 weight parts of a polymer and preferably in the range of 3 to 15 weight parts.

(2) Organic Pigments

Conventionally known organic pigments may be employed. Any of pigments may be employed. In the following, specific organic pigments are shown.

Pigments for magenta or red include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, etc.

Pigments for orange or yellow include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, etc.

Pigments for green or cyan include C.I. Pigment Blue 15, C.I. Pigment Blue 15:2, C.I. Pigment Blue 15:3, C.I. Pigment Blue 16, C.I. Pigment Blue 60, C.I. Pigment Green 7, etc.

These organic pigments may be employed individually or in combination of a plurality of them in accordance with requirements. Furthermore, the addition amount of the pigment is generally in the range of 2 to 20 weight parts for a polymer and preferably in the range of 3 to 15 weight parts.

(3) Surface Improving Agents

Conventionally known surface improving agents for colorants may be employed. Specifically, may be preferably employed silane compounds, titanium compounds, aluminum compounds, etc.

The silane compounds include alkoxysilanes such as methyltrtrimethoxysilane, phenyltrimethoxysilane, methylphenyldimethoxysilane, diphenyldimethoxysilane, etc.; silazozne such as hexamethyldisilazane etc., γ-chloropropyltrimethoxysilane, vinyltrichlorosilane, vinyltromethoxysilane, vinyltriethoxysilane, γ-methacryroxypropyltrimethoxysilane, γ-gulicidoxypropyltrimethoxysilane, γ-mercaptopropyltrimethoxysilane, γ-aminopropyltriethoxysilane, γ-ureidopropyltriethoxysilane, etc.

The titanium compounds include, for example, TTS, 9S, 38S, 41B, 46B, 55, 138S, 238S, etc. which are manufactured by Ajinomoto Co., Ltd. and are available on the market under the product name "Plainact", and A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP, etc. which are manufactured by Nippon Soda Co., Ltd. and are available on the market.

As the aluminum compounds, for example, are listed "Plainact AL-M", etc. manufactured by Ajinomoto Co., Ltd.

The concentration of any of these surface improving agents in a colorant is 0.01 to 20 weight percent and preferably 1 to 15 weight percent.

In addition to the above-mentioned additives, other additives are preferably added to the polymer particles when employed as a toner. Representative additives thereof are a fixability improving agent or a charge control agent.

(4) Fixability Improving Agents

Known fixability improving agents are employed. Generally, polyolefin series are employed. For example, are employed low molecular weight polyethylene, low molecular weight polypropylene, polyethylene subjected to oxidation treatment, polyethylene and polypropylene subjected to acid modification treatment, etc.

(5) Charge Control Agents

Known charge control agents are also employed. However, when monomers having a polar group on the surface of the polymer particle are subjected to copolymerization, sometimes the additive is not required. The polar group herein represents a group having a charge irrespective of its polarity such as a carboxyl group, a sulfonic acid group, an amino group, an ammonium salt group, etc.

The charge control agents include positively charged agents such as nigrosine dye, alkoxylated amine, quartenary ammonium salt, alkyl amide, etc. and negatively charges agents such as azo series metal complex, chlorinated paraffin, chlorinated polyester, sulfonyl amine of copper phthalocyanine, etc.

(External Additives)

In the present invention, when the polymer particles are washed and dried followed by preparing a toner for developing an electrostatic image, various additives such as a fluidizing agent, a charge control agent, a lubricant, etc. are generally added in order to improve the fluidity and coagulating properties. Inorganic fine particles or organic fine particles are used as the fluidizing agent or the charge control agent.

(1) Inorganic Fine Particles

Conventionally known inorganic fine particles may be employed. Specifically, fine particles of silica, titanium, alumina, etc. may be preferably employed.

Silica fine particles include, for example, commercially available products R-805, R-976, R-974, R-972, R-812 and R-809 which are manufactured by Nihon Aerosil Co., Ltd.; commercially available products HVK-2150 and H-200 manufactured by Hoechst Co., Ltd.; commercially available products TS-720, TS-530, TS-610, H-5 and NS-5 which are manufactured by Cabot Co., Ltd. and the like.

Titanium fine particles include, for example, commercially available products T-805 and T-604 manufactured by Nihon Aerosil Co., Ltd.; commercially available products MT-100S, MT-100B, MT500BS, MT-600, MT-600SS and JA-1 manufactured by Teika Co., Ltd.; commercially available products TA-300SI, TA-500, TAF-130, TAF-510 and TAF-510T manufactured by Fuji Titan Co., Ltd.; commercially available products IT-S, IT-OA, IT-OB and IT-OC manufactured by Idemitsu Kosan Co., Ltd. and the like.

Alumina fine particles include, for example, commercially available products RFY-C and C-604 manufactured by Nihon Aerosil Co., Ltd.; commercially available product TTO-55 manufactured by Ishihara Sangyo Kaisha Ltd., etc.

(2) Organic Fine Particles

The charge control agents include, for example, polyfluorovinylidene, polystyrene powder, polymethylmethacylate powder, polyethylene fine particles, etc. (0078)

(3) Lubricants

Lubricants include, for example, stearic acid salts of cadmium, barium, nickel, cobalt, strontium, copper, magnesium, calcium, etc. and metal salts of higher fatty acid such as zinc oleate, zinc palmitate, zinc linoleate, zinc ricinoleate, lead caprylate, lead caproate, etc. Any of these is added when required.

The polymer particle content of the toner is preferably 50 to 100 weight parts, and more preferably 80 to 100 weight parts.

There is no limitation on the particle size of the toner itself of the present invention. However, the toner having a small particle size tends to exhibit the advantage of the present invention. The volume average particle size is preferably 2 to 10 μm and particularly preferably from 3 to 9 μm. The particle size may be controlled by the concentration of a coagulating agent, the addition amount of an organic solvent and furthermore the composition of the polymer itself.

The following cases may be considered for use of the toner of the present invention; for example, the toner comprising a magnetic material is employed as a single component toner; the toner is mixed with a so-called carrier and is individually employed as a two component developer; the toner is employed as a non-magnetic toner, and the like. The toner may be suitably applied to any of the above cases. However, in the present invention, it is particularly preferred that the toner is mixed with the carrier and employed as the two component developer.

As the carrier constituting the two component developer, any of a non-coated carrier which is composed only of particles of magnetic materials such as iron, ferrite, etc. or a resin coated carrier in which the surface of the particle of a magnetic material is covered with a resin, etc. The average particle size of the carrier is preferably in the range of 30 to 150 μm in terms of volume average particle size. There is no particular limitation on the covering resin. The example includes styrene-acrylic resin.

(Image Forming Method)

There is no particular limitation on the developing process to which the toner of the present invention may be applied. The toner may be suitably applied to a contact developing process, a non-contact developing process and the like. The toner of the present invention exhibits particularly rapid charge rising properties and is preferably applied to the non-contact developing method. Namely, because in the non-contact developing method, variation in a developing electric field is large, minute variation in the charge amount affects highly the development itself. However, since the toner of the present invention demonstrates the rapid charge rising properties, the variation in the charge amount is small and the stable charge amount may be secured. As a result, even in the non-contact developing method, consistent images are prepared for a long period of time.

With the development utilizing the contact developing process, the thickness of the developer layer comprising the toner of the present invention is preferably from 0.1 to 8 mm and particularly preferably from 0.4 to 5 mm in the developing zone. Furthermore, the gap between a photoreceptor and a developer holding member is preferably from 0.15 to 7 mm and more preferably from 0.2 to 4 mm.

Furthermore, with the non-contact developing process, there is no contact of the developer layer formed on the developer holding member with the photoreceptor. For constituting the developing process, it is preferred that the developer layer is formed in a thin layer. In this method, the developer layer having a thickness of 20 to 500 $\mu$m in the developing zone on the surface of the developer holding member is formed, and the gap between the photoreceptor and the developer holding member is adjusted so as to be larger than the thickness of the above-mentioned developer layer. The thin layer is formed by a magnetic blade utilizing magnetic force, a method in which a developer layer regulating stick is pushed onto the surface of the developer holding member, etc. Furthermore, there is another method in which the developer layer is regulated by contacting a urethane blade, phosphor bronze plate, etc. on the surface of the developer holding member. The pushing pressure of a pushing pressure regulating member is preferably from 1 to 15 gf/mm. When the pushing pressure is insufficient, transportation tends to become unstable on account of the insufficient regulating force. On the other hand, when the pushing pressure is large, impact to the developer becomes large and the durability of the developer is liable to be degraded. Particularly preferred range is from 3 to 10 gf/mm.

Furthermore, when development bias is applied at the development, either method may be employed in which direct current component is only applied or alternative current bias is applied.

As the dimension of the developer holding member, 10 to 40 mm in diameter is suitable. When the diameter is small, the capability for mixing a developer becomes insufficient and it becomes difficult to provide sufficient charge to the toner. When the diameter is large, the centrifugal force becomes large for the developer and a problem such as scattering toner is liable to be caused.

In the following, an example of the non-contact developing process is explained with reference to FIG. 1.

FIG. 1 is a schematic diagram of a developing section of a non-contact developing process which may be employed suitably for the image making method of the present invention. The numeral 1 is a photoreceptor; 2 is a developer holding member; 3 is a two component developer comprising the toner of the present invention; 4 is a developer layer regulating member; 5 is a developing zone; 6 is a developer layer and 7 is an electric power source for forming an alternating electric field.

The two component developer comprising the toner of the present invention is held by magnetic force on the developer holding member 2 which comprises internally a magnet 2B and is transported to the developing zone 5 by the movement of a developing sleeve 2A. At the transportation, the thickness of the developer layer 6 is adjusted by the developer layer regulating member 4 in the developing zone 5 so that no contact with the photoreceptor 1 is caused.

The minimum distance (Dsd) between the photoreceptor 1 and the developer holding member 2 is larger than the thickness (BH) of a developer layer at the developing zone 5. Dsd is preferably 100 to 1,000 $\mu$m, and BH is preferably 20 to 500 $\mu$m. The electric power source 7 for forming the alternating electric field supplies preferably an alternating current having frequency of 1 to 10 kHz and voltage of 1 to 3 kVp-p. The electric power source 7 may take a construction in which direct current is supplied in series to alternating current if desired. The voltage of the direct current applied is preferably from 300 to 800 V.

Figure 3:
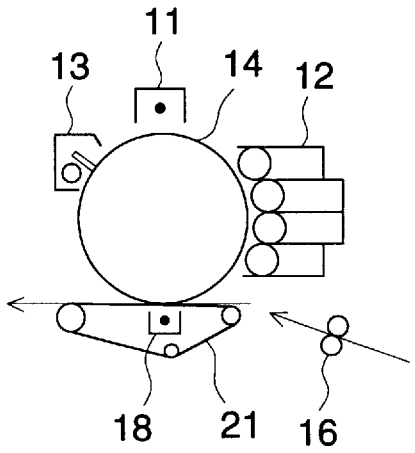
FIG. 3 is a schematic diagram showing a simultaneous transferring system.

When the toner of the present invention is applied to a color imaging system, there are provided methods in which a one-colored image is formed on a photoreceptor and the resulting image is successively transferred to an image receiving support (this is termed successive transferring system and is shown in FIG. 1.) or on the photoreceptor, a one-colored image is developed a plurality of times to obtain superimposed colored images and the resulting images are simultaneously transferred to an image receiving support (this is termed simultaneous transferring method and is shown in FIG. 3.).

Figure 2:
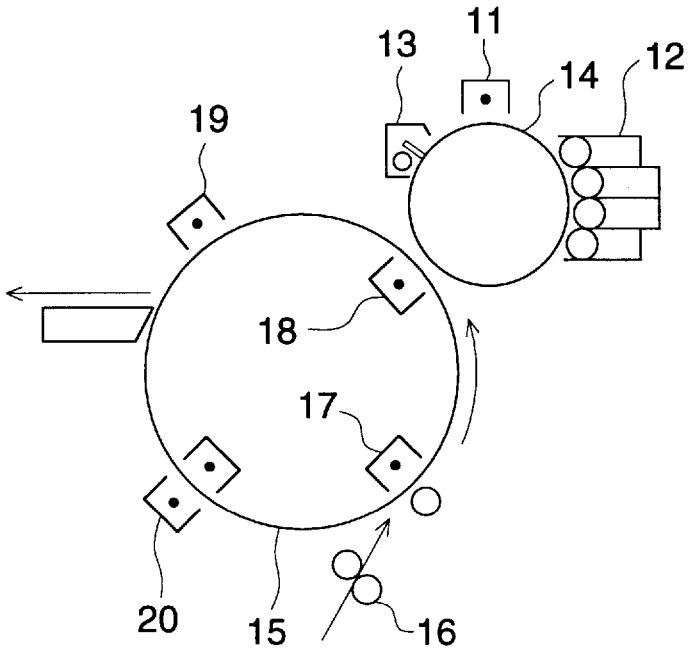
FIG. 2 is a schematic diagram showing one example of a successive transferring system.

The image forming methods shown in FIGS. 2 and 3 are explained in detail in the following.

As a developer holding member employed in the present invention, as shown in FIG. 1, a developing device in which the magnet 2B is built in the holding member. As the developing sleeve 2A, aluminum, surface-oxidized aluminum or stainless steel is employed.

In the following, one example of the successive transferring system shown in FIG. 2 is explained.

The numeral 11 is a charging electrode; 12 is a developing unit composed of developing devices which supply each of yellow, magenta, cyan and black toners, which is divided into four vessels. The basic construction of these developing units is the same as the schematic diagram of the developing section shown in FIG. 1. The numeral 14 is a photoreceptor drum; 13 is a cleaning unit; 15 is a transferring drum which holds temporarily a one-colored toner image on the photoreceptor drum and holds another one-colored image and holds a desired multicolored image; 16 is a transporting unit which transports an image receiving material to which the toner image on the transferring drum is transferred; 17 is an adhering electrode which is arranged in the interior of the transferring drum 15 and adheres electrostatically the image receiving material to the above-mentioned drum by corona discharging from the inside; 18 is a transferring electrode which transfers successively the toner image formed on the photoreceptor drum 14 to the transferring drum; 19 is a peeling electrode which peels the image receiving material adhered electrostatically on the transferring drum 15; 20 is a charge eliminating electrode which eliminates remaining charge in the transferring drum after transferring and peeling.

On the photoreceptor drum 14, is uniformly formed charges by the charging electrode 11, An image-wise exposure is then made (means is not shown.), and an electrostatic latent image is formed. The electrostatic latent image is developed utilizing the developing device having one color of the toner (for example, black toner) of the developing unit 12 and one-colored toner image is formed on the photoreceptor drum. On the other hand, the image receiving material transported on the transferring drum 15 by the transporting unit 16 is electrostatically adhered on the transferring drum by the adhering electrode 17 and is transported to a transferring section.

The above-mentioned toner image formed on the photoreceptor drum 14 in the transferring section is transferred to the image receiving material transported. The toner remains on the photoreceptor drum 14 after the above-mentioned toner image is transferred. The remaining toner is cleaned by a cleaning unit 13 and is employed in the following process. When forming a multicolored image, according to the similar process, other colored toner image is formed by development, and is transferred successively to the transferring drum 15. Finally, the image receiving material on which a desired toner image is transferred is peeled by the peeling electrode 19 and transported to a fixing section and a fixed multicolored image is finally obtained. On the other hand, the remaining charge on the transferring drum 15 is eliminated by the charge eliminating electrode 20 and the transferring drum is employed in the next process.

Next, with reference to FIG. 3, the simultaneous transferring system is explained.

Explanation on each part of the equipment is abbreviated, because it is the same as that in the example of FIG. 2. However, 21 is a transporting section which transfers a toner image while transporting an image receiving material transported. On a photoreceptor drum 14, charges are uniformly formed by a charging electrode. Then, an electrostatic latent image is formed by a latent image forming means (not shown). The electrostatic latent image is developed using a developing device having one colored toner (for example, black toner) of a developing unit 12 and a one-colored toner image is formed on a photoreceptor drum. In the example shown in the figure, the toner image is not transferred and on the photoreceptor drum having the above-mentioned toner image, charges are again formed by the charging electrode 11; furthermore, an electrostatic latent image is formed; and is developed using a developing device having a different colored toner from the above-mentioned one; another colored toner image is formed by superimposing on the previously formed toner image. During the above process, a cleaning unit 13, a transferring electrode 18, and a transporting section 21 are not operated and are withdrawn so that the toner image on the photoreceptor drum 14 is not damaged.

A desired image multicolored toner image is formed, The resulting toner image on the photoreceptor drum while being transported to a transporting section 21, is then transferred to the image receiving material transported by a transporting unit 16. The image receiving material holding the transferred toner image is transported to a fixing section, fixed and a final multicolored toner image is formed on the image receiving material. Because the toner remains on the photoreceptor drum, it is cleaned by the cleaning unit 13 and the cleaned photoreceptor is used in the next process.

In the above-mentioned various methods, a toner image formed on the photoreceptor drum is transferred to an image receiving material such as a sheet of paper. The transferring process is not limited and various processes such as a so-called corona transferring process or a roller transferring process may be utilized.

The toner of the present invention has high transferring efficiency and remains a little on the photoreceptor. Therefore, when, for example, a blade cleaning method is employed, a contact enforcing pressure of the blade on the photoreceptor and the like may be reduced and an advantage is effected such as the extension of the life of the photoreceptor and the like.

After the toner image is transferred to the image receiving material, the toner remaining on a photoreceptor is cleaned with cleaning and the photoreceptor is repeatedly employed.

In the present invention, there is no particular limitation on the method for cleaning. Known cleaning methods such as a blade cleaning method, a magnetic brush cleaning method, a fur brush cleaning method, etc. may be optionally employed. According to the reason mentioned above, a suitable cleaning method is the blade cleaning system using a so-called cleaning blade.

(EXAMPLE)

In the following, the present invention is explained in detail with reference to examples. However, the embodiments of the present invention are not limited to the examples.

Preparation Example 1

(Preparation of Colorant Dispersion)

To 25.6 kg of carbon black (Regal R330 manufactured by Cabot Co.) as a colorant, 11.98 kg of sodium dodecylsulfate and 265 liters of deionized water were added and mixed. A pressurized dispersion homogenizer (NPH-70) manufactured by Nihon Seiki Seisakusho was then employed to prepare the colorant dispersion in which dispersion was performed so that the particle size of the colorant became not more than 10 times the primary particle size of the carbon black. The primary particle size of the carbon black is ordinarily 10 to 100 nm.

(Preparation Method of Colored Polymer Particle Dispersion)

To a 1,000-ml separable flask equipped with a stirring device, a temperature sensor, cooling tubing and nitrogen gas introducing device, were added 124 ml of deionized water, 21 ml of the above-mentioned colorant dispersion, 4.64 g of WAX emulsion (prepared by heating polypropylene having a number average molecular weight of 3,000 at a higher temperature than its melting point and dispersing the resultant to form an emulsion), and further, 16.4 g of styrene, 2.48 g of acrylic acid normal butyl, 0.07 g of acrylic acid and 0.30 g of t-dodecymercaptan. The resulting mixture was heated to the inner temperature of 75° C. under nitrogen gas flow, while stirring at the stirring speed of 250 rpm. When the inner temperature rose to 75° C., an aqueous polymerization initiator solution prepared by dissolving 0.50 g of potassium persulfate in 30 ml of deionized water was added and polymerization was conducted for three hours and the temperature was then lowered down to 40° C. (first stage)

When the temperature of the solution was lowered down to 40° C., to the 1,000-ml separable flask containing the polymer solution was added 312 ml of deionized water to which 60 ml of the above-mentioned colorant dispersion, 13.44 g of WAX emulsion (the same as mentioned above), 36.6 g of styrene, 8.88 g of acrylic acid normal butyl, 0.45 g of acrylic acid and 1.44 g of t-dodecylmercaptan, and the resulting mixture was heated to 75° C. of the inner temperature with stirring at 500 rpm under nitrogen gas flow. When the inner temperature was raised to 75° C., an aqueous polymerization initiator solution prepared by dissolving 1.34 g of potassium persulfate in 85 ml of deionized water was added and the resulting mixture was subjected to polymerization for three hours and was then cooled to 40° C., and stirring was stopped. (second stage)

The resulting dispersion containing the carbon black was termed "Dispersion 1".

The particle size of the dispersed particle was measured using an electrophoretic particle distribution measurement apparatus ELS-800 (manufactured by Ootsuka Denshi Co., Ltd.). The volume average particle size obtained was 0.10 $\mu$m.

(Non-spherical Particle and Preparation of Toner)

Into of a 500-liter stainless steel resection vessel equipped with an Anchor stirring blade, a temperature sensor, a nitrogen gas introducing device, was added 150 liters of the above obtained dispersion and was stirred at 100 rpm at room temperature. To the dispersion, 1.37 kg of New Coal 565C (manufactured by Nihon Nyukazai) was added and after stirring, a 5N sodium hydroxide solution was added dropwise until the pH was raised to 9.80. Then, a potassium chloride solution prepared by dissolving 15.67 kg of potassium chloride in 79 liters of deionized water was added followed by the addition of an aqueous solution prepared by dissolving 39 liters of isopropanol, 1.24 kg of New Coal 565C in 30 liters of deionized water. The temperature of the mixture when the addition was completed was 31.0° C. The mixture was then heated to 85° C. and was subjected to reaction for 6 hours at a temperature 85° C. of the mixture (variation was ±3° C. or less.) and cooled to room temperature (40° C. or lower).

The particle size of the resulting dispersion was measured using a laser diffraction particle size distribution measurement apparatus SALD-1100 (manufactured by Shimadzu Corporation). As a result, non-spherical particle having a volume average particle size of 6.55 $\mu$m was obtained. Furthermore, the non-spherical particles were separated by filtration; were then dispersed into distilled water; the pH of the resulting dispersion was adjusted to 13 using an aqueous 5N sodium hydroxide solution so that carboxlyic acid was perfectly dissociated; the resulting dispersion was then washed once by 2,000 liters of water; furthermore, was washed 8 times by 200 liters of a mixture composed of water/methanol =7/3 in order to remove to some extent contaminants such as ionic surface active agents; was filtrated and dried. Thus the toner was obtained.

Preparation Example 2

Toner 2 was prepared in the same manner as in Preparation Example 1 except that C.I. Pigment Blue 15:3 was employed instead of the carbon black (Regal R330 manufactured by Cabot Co.).

Preparation Example 3

Toner 3 was prepared in the same manner as in Preparation Example 1 except that C.I. Pigment Red 122 was employed instead of the carbon black (Regal R330 manufactured by Cabot Co.).

Preparation Example 4

Toner 4 was prepared in the same manner as in Preparation Example 1 except that C.I. Pigment Yellow 17 was employed instead of the carbon black (Regal R330 manufactured by Cabot Co.).

Preparation Example 5

Toner 5 was prepared in the same manner as in Preparation Example 1 except that at the preparation of Dispersion 1, the amount of acrylic acid was 0.09 g at the first stage and 0.48 g at the second stage, and at the preparation of the colorant dispersion, an ultrasonic homogenizer (US-150T) manufactured by Nihon Seki Seisakusho was employed together.

Preparation Example 6

Toner 6 was prepared in the same manner as in Preparation Example 5 except that at the preparation of the non-spherical particles, a solution prepared by dissolving 13.86 kg of potassium chloride in 80 liters of distilled water was added and isopropanol was only added without using New Coal 565C (manufactured by Nihon Nyukazai).

Preparation Example 7

Toner 7 was prepared in the same manner as in Preparation Example 3 except that at the preparation of Dispersion 1, the amount of acrylic acid was 0.02 g at the first stage and 0.25 g at the second stage, and at the preparation of the non-spherical particles, a solution prepared by dissolving 13.86 kg of potassium chloride in 80 liters of distilled water and then, 80 liters of isopropanol was only added without using New Coal 565C (manufactured by Nihon Nyukazai).

Preparation Example 8

Toner 8 was prepared in the same manner as in Preparation Example 3 except that at the preparation of Dispersion 1, the amount of acrylic acid was 0.22 g at the first stage and 0.78 g at the second stage, and an ultrasonic homogenizer (YS-150T) manufactured by Nihon Seiki Seisakusho was employed together.

Comparative Preparation Example 1

Comparative Toner 1 was prepared in the same manner as in Preparation Example 1 except that at the preparation of Dispersion 1, the amount of acrylic acid was 0.005 g at the first stage and 0.071 at the second stage Comparative Preparation Example 2

Comparative Toner 2 was prepared in the same manner as in Preparation Example 2 except that at the preparation of Dispersion 1, the amount of acrylic acid was 0.01 g at the first stage and 0.12 g at the second stage.

Comparative Preparation Example 3

Comparative Toner 3 was prepared in the same manner as in Preparation Example 3 except that at the preparation of Dispersion 1, the amount of acrylic acid was 0.22 g at the first stage and 1.42 g at the second stage.

Comparative Toner 4 was prepared in the same manner as in Preparation Example 4 except that at the preparation of Dispersion 1, the amount of acrylic acid was 0.15 g at the first stage and 1.03 g at the second stage.

(BET Value)

The BET value was measured using a Flowsorb II2300 manufactured by Shimadzu Corporation, while employing a one point method under nitrogen gas. The results measured are shown in Table 1.

TABLE 1

| Sample | BET Value $m^2/g$ |
|---|---|
| Toner 1 | 7.54 |
| Toner 2 | 15.11 |
| Toner 3 | 9.28 |
| Toner 4 | 23.19 |
| Toner 5 | 10.11 |
| Toner 6 | 15.67 |
| Toner 7 | 6.21 |
| Toner 8 | 15.78 |
| Comparative Toner 1 | 24.65 |
| Comparative | 19.12 |

TABLE 1-continued

| Sample | BET Value $m^2/g$ |
|---|---|
| Toner 2 Comparative Toner 3 | 23.77 |
| Comparative Toner 4 | 16.82 |

(Measurement Example of Surface Carboxyl Group Amount A)

As a pretreatment, dialysis was performed and free salts and the like were removed. The solid concentration of "Dispersion 1" of Preparation Example 1 was then measured using an infrared water content meter (manufactured by Carl Zeis Co.) and 8.18% was obtained.

In a beaker, 25.0 g of the "Dispersion 1" of the Preparation Example 1 was placed and according to the calculation from the solid concentration, was diluted with pure water so that the solid concentration became 5.00% (solid : 1.25 g).

The above-mentioned solution was titrated with a 0.05N sodium hydroxide solution using a conductometric titorator (AB91 AUTOBURETTE+COM80 CONDUCTIVITY METER manufactured by Kanto Kagaku Co.). As a result, the titration curve as shown in FIG. 4 was obtained.

Figure 4:
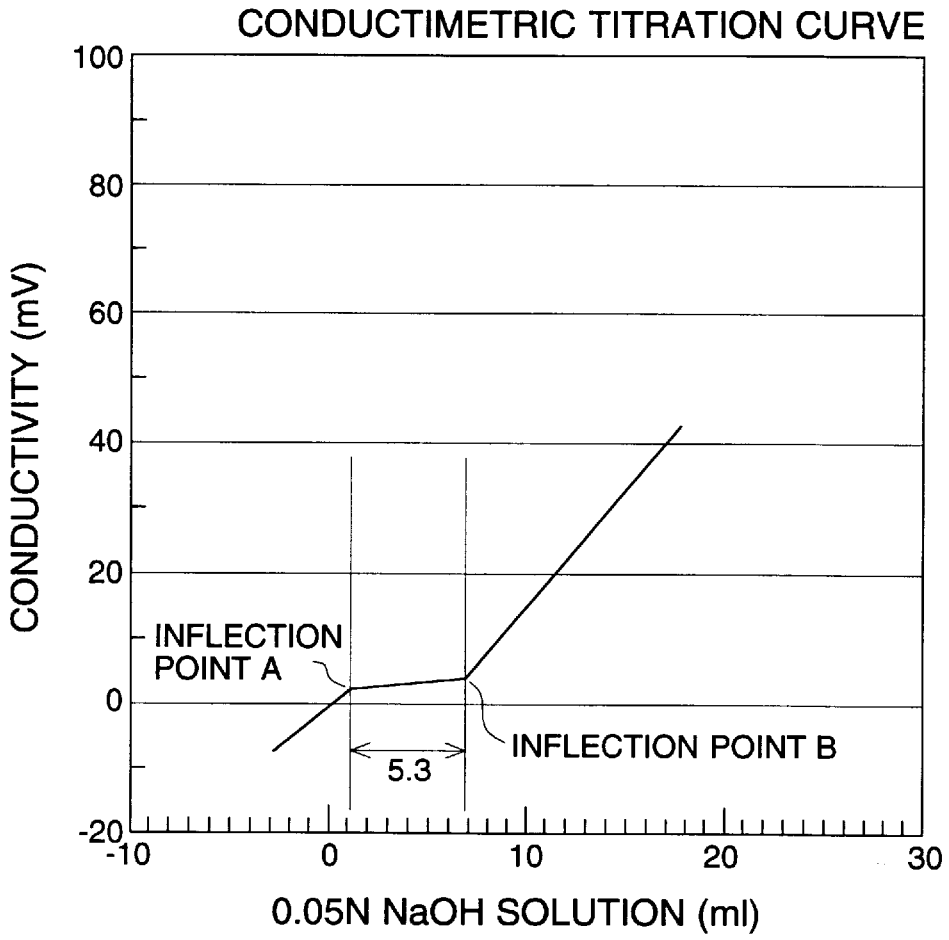
FIG. 4 is a titration curve of surface carboxyl group.

In FIG. 4, according to the titration curve (between inflection points A and B) of the surface carboxylic group, the amount of a 1/20N sodium hydroxide solution required to neutralize the surface carboxyl group was 5.3 ml.

According to Formula (1), the valence number of the carboxyl group and sodium ion each were 1. Therefore, the amount ($M_L$) of the surface carboxyl group was $2.65\times10^{-4}$ mol.

Amount of surface carboxyl group $$=0.05(N)\times(5.3\times10^{-3}(ml))$$

$$=2.65\times10^{-4}(mol) \qquad \text{Formula (1)}$$

On the other hand, the average particle size of the "Dispersion 1" of Preparation Example 1 was measured using an electrophoretic particle size measurement apparatus ELS800 manufactured by Ootsuka Denshi Co. The volume average particle size obtained was 0.20 $\mu$m.

The surface area of the polymer particles in 25.0 g of the "Dispersion 1" measured was calculated as follows.

The specific gravity of the dried latex was measured using a True Specific Gravity Meter manufactured by Esutec Co. and 1.01 of the specific gravity (Sp) was obtained. Accordingly;

(weight of one latex particle: $W_L$ g)

$$W_L=(4/3)\pi r^3\times Sp$$

(Surface area of one latex particle: $S_L$ $cm^2$)

$$S_L=4\pi r^2$$

According to the above relations, $$S_L=(3/r)\times Sp\times W_L \qquad \text{Formula (2)}$$

The dispersed particle size was measured using an electrophoretic particle distribution measurement apparatus ELS-800 (manufactured by Ootsuka Denshi Co., Ltd.) and the volume average particle size obtained was 0.20 $\mu$m. Accordingly, $$r=0.10\ \mu m=0.000010\ cm$$

According to the Formula (2), $$S_L=3.0\times10^5\times W_L cm^2$$

From $W_L$=1.25 g, $$S_L=3.75\times10^5\ cm^2$$

(amount of carboxyl group per unit surface area)

$$M_L/S_L=7.07\times10^{-10}\ mol/cm^2 \text{ is obtained.}$$

The amount of the surface carboxyl group corresponds to the mol number of sodium hydroxide employed in the above-mentioned measurement. Thus, the amount is described herein in mol/g.

(Amount of Surface Carboxyl Group)

Each of the amount A of the surface carboxyl group measured as mentioned above is described in Table 3 in the following.

TABLE 2

| Sample | Amount of surface Carboxyl Group $mol/cm^2$ |
|---|---|
| Toner 1 | $7.07\times10^{-10}$ |
| Toner 2 | $8.56\times10^{-10}$ |
| Toner 3 | $5.46\times10^{-10}$ |
| Toner 4 | $1.23\times10^{-10}$ |
| Toner 5 | $1.21\times10^{-9}$ |
| Toner 6 | $2.36\times10^{-9}$ |
| Toner 7 | $8.56\times10^{-11}$ |
| Toner 8 | $9.97\times10^{-11}$ |
| Comparative Toner 1 | $5.36\times10^{-12}$ |
| Comparative Toner 2 | $2.95\times10^{-11}$ |
| Comparative Toner 3 | $5.96\times10^{-8}$ |
| Comparative Toner 4 | $6.36\times10^{-9}$ |

(Evaluation Example)

(Charge Amount and Developed Amount)

The charge amount was measured as follows. Each of the toners of the present invention and the comparative toners was mixed at a toner concentration of 5% with a carrier prepared by coating ferrite particles having an average particle size of 60 $\mu$m with a styrene/methylmethacrylate copolymer to obtain a developer. The resulting developer was rested for 50 hours under different environments (high temperature and high humidity HH (temperature 30° C., humidity 80%) and low temperature and low humidity LL (temperature 10° C., humidity 20%). The charge amount was then measured. The results are shown in Table 3 below.

TABLE 3

| Sample | Charge Amount ($\mu$C/g) LL | HH |
|---|---|---|
| Toner 1 | | −24.8 |
| Toner 2 | | −23.6 |
| Toner 3 | | −25.8 |
| Toner 4 | | −24.0 |
| Toner 5 | | −26.0 |

TABLE 3-continued

| Sample | Charge Amount (μC/g) LL | HH |
|---|---|---|
| Toner 6 | | −26.5 |
| Toner 7 | | −25.9 |
| Toner 8 | | −25.3 |
| Comparative Toner 1 | | −50.5 |
| Comparative Toner 2 | | −38.6 |
| Comparative Toner 3 | | −26.9 |
| Comparative Toner 4 | | −25.0 |

The measurement of the developed amount was performed using a Full Color Copier "Konica 9028" manufactured by Konica Corporation, which was modified so that the developing device was operable as a single unit. Each of the developers of the inventive examples of the present invention and the comparative examples was put in the developing device. Under different environments (high temperature and high humidity HH (temperature 30° C., humidity 80%), or low temperature and low humidity LL (temperature 10° C., humidity 20%), stirring was performed. Then, developability, that is, the developed amount per unit area was measured on a photoreceptor. The results are shown in Table 4 below.

TABLE 4

| Sample | Charge Amount (μC/g) LL | HH | Developed Amount (mg/cm$^2$) LL | HH |
|---|---|---|---|---|
| Toner 1 | −24.8 | −24.6 | 0.75 | 0.77 |
| Toner 2 | −23.6 | −23.2 | 0.72 | 0.73 |
| Toner 3 | −25.8 | −25.2 | 0.80 | 0.82 |
| Toner 4 | −24.0 | −24.8 | 0.85 | 0.86 |
| Toner 5 | −26.0 | −23.5 | 0.86 | 0.74 |
| Toner 6 | −26.5 | −22.4 | 0.87 | 0.72 |
| Toner 7 | −25.9 | −21.5 | 0.79 | 0.70 |
| Toner 8 | −25.3 | −21.8 | 0.77 | 0.69 |
| Comparative Toner 1 | −50.0 | −24.3 | 0.52 | 0.72 |
| Comparative Toner 2 | −42.9 | −25.9 | 0.62 | 0.83 |
| Comparative Toner 3 | −25.6 | −12.0 | 0.75 | 0.97 |
| Comparative Toner 4 | −24.5 | −13.9 | 0.77 | 0.93 |

Since the toner of the present invention holds the carboxyl group on the particle surface, it is excellent in charging properties and shows small variation in the charge amount and developed amount at high temperature and high humidity HH (temperature 30° C., humidity 80%) and low temperature and low humidity LL (temperature 10° C., humidity 20%). On the other hand, in the comparative toner, toners having a large amount of the carboxyl group on the toner surface shows low charge amount and large developed amount at high temperature and high humidity HH (temperature 30° C., humidity 80%) and toners having small amount of the carboxyl group on the toner surface shows high charge amount and small developed amount at low temperature and low humidity LL (temperature 10° C., humidity 20%). In both cases, the charge amount and developed amount show big difference due to environments.

With the use of the above-mentioned developer, practical copy making test was performed using an electrophotographic copier Konica U-BIX 3035 (manufactured by Konica Corporation). Regarding items mentioned below, when ten thousand copies were continuously made, the characteristics were evaluated. However, "Toner 4 " was evaluated using a Konica 9028 (manufactured by Konica Corporation).

Furthermore, density was measured using a Sakura densitometer PDA-60 (manufactured by Konica Corporation), while letting the reflection density of a white part be 0.

The results are shown in Table 5.

TABLE 5

| Sample | Fog Evaluation Result Fog Density LL | HH | Density Decrease Evaluation Results Maximum Image Density LL | HH |
|---|---|---|---|---|
| Toner 1 | 0.007 | 0.008 | 1.356 | 1.345 |
| Toner 2 | 0.009 | 0.009 | 1.322 | 1.333 |
| Toner 3 | 0.010 | 0.008 | 1.299 | 1.288 |
| Toner 4 | 0.008 | 0.011 | 1.331 | 1.334 |
| Toner 5 | 0.011 | 0.010 | 1.321 | 1.300 |
| Toner 6 | 0.012 | 0.010 | 1.278 | 1.298 |
| Toner 7 | 0.012 | 0.009 | 1.289 | 1.234 |
| Toner 8 | 0.008 | 0.007 | 1.345 | 1.236 |
| Comparative Toner 1 | 0.012 | 0.004 | 0.789 | 1.339 |
| Comparative Toner 2 | 0.013 | 0.003 | 1.067 | 1.341 |
| Comparative Toner 3 | 0.009 | 0.050 | 1.267 | 1.256 |
| Comparative Toner 4 | 0.008 | 0.025 | 1.250 | 1.245 |

Since on the particle surface of the toner of the present invention is a suitable amount of carboxyl group, it shows excellent charging properties and yields sharp and clear images without forming fog and decreasing density at high temperature and high humidity HH (temperature 30° C., humidity 80% and low temperature and low humidity (temperature 10° C., humidity 20%). On the other hand, regarding the comparative toners, ones having a large amount of carboxyl group on the surface of the toner particle caused fog at high temperature and high humidity (temperature 30° C., humidity 80%) and ones having a small amount of carboxyl group on the surface of the toner particle caused decrease in density at low temperature and low humidity (temperature 10° C., humidity 20%).

What is claimed is:

1. A toner for developing an electrostatic latent image, the toner containing polymer particles having a carboxyl group on the surface thereof in the range of $$5\times10^{-11}\ \text{mol/cm}^2 \leqq A \leqq 3\times10^{-9}\ \text{mol/cm}^2,$$

wherein A represents an amount of the carboxyl group obtained using a conductometric titration method.

2. The toner of claim 1, wherein said carboxyl group amount A is in the range of $$8\times10^{-11}\ \text{mol/cm}^2 \leqq A \leqq 1.5\times10^{-9}\ \text{mol/cm}^2.$$

3. The toner of claim 1, having a BET specific surface area of 5 to 100 m$^2$/g.

4. The toner of claim 1, having an average volume particle size of 2 to 10 $\mu$m.

5. The toner of claim 1, wherein the toner contains said polymer particles in an amount of 50 to 100 weight parts.

6. The toner of claim 1, wherein the toner contains polymer particles and a colorant.

7. The toner of claim 6, wherein the colorant is carbon black.

8. A developer for developing an electrostatic latent image, the developer comprising a toner and a carrier, the toner containing polymer particles having a carboxyl group on the surface thereof in the range of $$5\times10^{-11}\ \text{mol/cm}^2 \leqq A \leqq 3\times10^{-9}\ \text{mol/cm}^2$$

wherein A represents an amount of the carboxyl group obtained using a conductometric titration method.

* * * * *